US006264130B1

(12) United States Patent
Hartley, Jr.

(10) Patent No.: US 6,264,130 B1
(45) Date of Patent: Jul. 24, 2001

(54) DUPLEX WEB ROLL WINDING AND SPLICING APPARATUS

(75) Inventor: John J. Hartley, Jr., Pewaukee, WI (US)

(73) Assignee: Faustel, Inc., Germantown, WI (US)

( * ) Notice: Subject to any disclaimer, the term of this patent is extended or adjusted under 35 U.S.C. 154(b) by 0 days.

(21) Appl. No.: 09/394,164

(22) Filed: Sep. 13, 1999

(51) Int. Cl.[7] ..... B65H 35/04

(52) U.S. Cl. ..... 242/527.3; 242/532.3; 242/531; 242/541.1

(58) Field of Search ..... 242/531, 530, 242/523, 527, 527.2, 527.4, 527.3, 523.1, 530.4, 541, 541.1, 541.7, 542.3, 531.1, 534, 541.4

(56) References Cited

U.S. PATENT DOCUMENTS

| | | | | |
|---|---|---|---|---|
| 1,518,428 | | 12/1924 | Hudson . | |
| 3,529,785 | | 9/1970 | Mistele . | |
| 3,633,839 | | 1/1972 | Clark . | |
| 3,658,272 | | 4/1972 | Bennett et al. . | |
| 3,792,824 | * | 2/1974 | Meyer et al. | 242/542.3 X |
| 3,823,887 | | 7/1974 | Gerstein . | |
| 3,869,095 | | 3/1975 | Diltz . | |
| 4,025,009 | | 5/1977 | Fineo . | |
| 4,055,313 | * | 10/1977 | Yamaguchi et al. | 242/530.4 |
| 4,095,754 | * | 6/1978 | Campo | 242/542.3 X |
| 4,117,986 | * | 10/1978 | Hutzenlaub | 242/530.4 |
| 4,155,515 | * | 5/1979 | Schunmeier et al. | 242/530.4 X |

(List continued on next page.)

FOREIGN PATENT DOCUMENTS

| | | |
|---|---|---|
| 2 105 688 | 9/1981 | (GB) . |
| 58-220038 | 12/1983 | (JP) . |
| 63-66053 | 3/1988 | (JP) . |

OTHER PUBLICATIONS

Simco brochure,*Chargemaster® Electrostatic Generating Equipment*, 1996.

Hurletron Incorporated brochure, *Hurleton® Ribbon Tacking 777*, 1987.

Drawings of I.M.D. Corp. vacuum transfer splicer: Sheet 1—Operator side view; Sheet 2—Front view A, A from sheet No. 1; Nov. 2, 1990.

Product brochure for Kampf RKW 10 "Roll Slitting and Winding Machine for Metal Tapes," Erwin Kampf GmbH & Co., West Germany.

Product brochure for Kampf RKW 6 "Special Roll Slitting and Winding Machine for Aluminum Foils and Thin Aluminum Tapes," Erwin Kampf GmbH & Co., West Germany.

*Primary Examiner*—William A. Rivera
(74) *Attorney, Agent, or Firm*—Boyle Fredrickson Newholm Stein & Gratz; James F. Boyle

(57) ABSTRACT

An apparatus and method of winding a continuously moving web, and for splicing and transferring the web from a first core to a second core with no-fold-back or wrinkling of the web material during the splice. The web is fed through a first nip point and thereby applied to a lay-on roll, the lay-on roll further applying the web material onto first and second cores alternatively. An electrostatic charging bar positioned downstream from the nip point emits an electrostatic charge onto the web to temporarily adhere the web to the lay-on roll. A rotatable cutting knife cooperatively engageable with the lay-on roll cuts the web at a point downstream from the electrostatic charging bar but upstream from the first and second cores to produce a tail and new leading edge. The tail continues to be wound about the first roll, and the new leading edge is affixed to the second roll and the web is thereafter wound about the second core. The first and second cores are each independently movable toward and away from the lay-on roll so the web may be spliced and transferred from the first core to the second core, and alternatively from the second core to the first core.

25 Claims, 9 Drawing Sheets

U.S. PATENT DOCUMENTS

| | | | | |
|---|---|---|---|---|
| 4,374,575 | | 2/1983 | Lerch et al. . | |
| 4,422,586 | | 12/1983 | Tetro . | |
| 4,431,140 | | 2/1984 | Tetro . | |
| 4,458,852 | | 7/1984 | Calvert et al. . | |
| 4,508,279 | | 4/1985 | Tokuno et al. . | |
| 4,508,283 | * | 4/1985 | Beisswanger | 242/530 |
| 4,530,265 | | 7/1985 | Lee et al. . | |
| 4,749,140 | | 6/1988 | Ruff . | |
| 4,852,820 | | 8/1989 | Looser . | |
| 4,932,599 | * | 6/1990 | Doerfel | 242/530.4 |
| 4,948,061 | | 8/1990 | Krimsky et al. . | |
| 4,951,900 | * | 8/1990 | Goerner | 242/530.4 X |
| 5,356,087 | * | 10/1994 | Smith et al. | 242/530.4 X |
| 5,368,253 | | 11/1994 | Hartley, Jr. | 242/527.4 |
| 5,499,778 | * | 3/1996 | Hehner et al. | 242/541 |

* cited by examiner

DUPLEX WEB ROLL WINDING AND SPLICING APPARATUS

BACKGROUND OF THE INVENTION

1. Field of the Invention

The present invention relates to a duplex web roll winding and splicing apparatus for continuously winding a moving web and also for splicing and transferring the web to a new core without stopping movement of the web. In particular, this invention relates to an apparatus and method for continuously winding and splicing a moving web onto a successive series of cores without causing a fold-back or wrinkling of the web.

2. Background of the Related Art

Many commercial and industrial laminating, coating and film processing operations are conducted on high speed web handling equipment which operate continuously for long periods of time. Paper converting is one example of such an operation. Numerous kinds of plastic film and thin foils are also processed in this manner. At the end of the processing line the web is wound lengthwise into a large roll of material commonly referred to in the trade as a parent roll, mill roll or finish roll. In the processing of web materials, it is inefficient to stop the entire operation each time an individual roll of material needs to be changed. For this reason, various types of winding and rewinding devices have been developed for cutting and transferring a moving web onto a new core so that successive rolls of material may be continuously wound without interrupting the web processing operation.

One such rewind device, commonly referred to in the trade as either a turnover rewind stand or turret rewinder, is disclosed in U.S. Pat. No. 3,529,785. A turnover rewind stand is comprised of a pair of rotatable spindles or cores mounted on opposite ends of a turret. During normal operation, one core is positioned close to the web processing line for rewinding the web, while the other core on the opposite end of the turret is positioned away from the web processing line. By revolving or "turning over" the turret, the spindle containing a fully wound roll of web material is moved away from the rewinding position and a new core is simultaneously moved into the rewinding position. The splice is accomplished by placing the moving web into contact with the new core, which is covered with an adhesive, and then severing the web with a knife at a point which is normally downstream from the new core. The web sticks to the new core and thereafter the web is rewound onto the new core. The finished roll, which is now positioned away from the processing line, may be removed and another new core put in its place. This process, referred to in the trade as splicing the web "on the fly," may be repeated over and over in order to rewind a number of rolls successively for as long as the web processing line is in operation.

The splicing step described above involves cutting the web at a point which is downstream from the new core, which causes a portion of the web to fold-back on itself on the new core when the splice is performed. This fold-back results in a double thickness of the web and wrinkling of the web at the core which is undesirable. While the affects of the fold-back may be alleviated after a number of revolutions on the new core, the fold-back nonetheless produces a significant amount of waste material.

Several devices have been developed in an effort to provide a "no-fold-back" transfer of a moving web. The applicant's prior U.S. Pat. No. 5,368,253, entitled Continuous Rewind With No-Fold-Back Splicer, discloses one such device. The device disclosed in the '253 patent uses a perforated knife to cut the web at a point which is upstream from the new core. Gaps in the perforated knife leave a set of tabs which hold the web together until the cut seam reaches the new core. At that point, the "new" leading edge of the web becomes bonded to a strip of adhesive on the new core. The adhesive bond overpowers the tabs thereby causing the tabs to break. As a result, the tail of the web continues on its normal path to become rewound about the old finish roll, while the new leading edge becomes bonded to the new core. The splice is made without the usual fold-back encountered in conventional splicing operation.

The applicant's prior U.S. Pat. No. 5,823,461 entitled No-Fold-Back Splicer with Electrostatic Web Transfer Device discloses another example of a splicing device for a rewinder which produces a no-fold-back splice. On the device disclosed in the '461 patent the web is fed through a first nip point formed by an introducer roll and a cushioned anvil roll, and then through a second nip point formed by the cushioned anvil roll and the new core. An electrostatic charging bar positioned downstream from the first nip point emits an electrostatic charge onto the web to temporarily adhere it to the cushioned anvil roll. A rotatable cutting knife which is cooperatively engageable with the cushioned anvil roll cuts the web at a point downstream from the electrostatic charging bar but upstream from the new core thereby forming a tail and a new leading edge. The tail continues to be rewound about a finish roll. Because the new leading edge of the web has been electrostatically charged it remains stuck to the cushioned anvil roll until it reaches the new core. At that point, adhesive on the new core peels the new leading edge of the web off of the cushioned anvil roll and affixes it onto the new core. The web is thereafter rewound about the new core.

However, the two devices disclosed in the '253 and '461 patents are both designed for use on or in connection with a turret style rewinder. As mentioned, a turret style rewinder includes a first core mounted on one end of the turret arm, and a second core mounted on the opposite end of the turret arm. The rewinding operation is normally conducted on the core that is located in the position closest to the end of the web processing line. In preparation for the splice, the turret arm is rotated so that the first core, which is ready to be finished and removed from the rewind stand, is rotated away from the web processing line and the new core is simultaneously rotated into position to take over the rewinding operation. (See, e.g., U.S. Pat. No. 5,368,253, FIGS. 1 and 2 and specification column 4, lines 30–50, and U.S. Pat. No. 5,823,461, FIG. 1 and specification column 3, line 66 to column 4, line 18.) During the period that the finish roll is positioned away from the web processing line, yet prior to splicing, the web must traverse a substantial distance while unsupported by any rollers or other structural components of the web processing equipment. Some web materials, such as very light weight films and foils, may become stretched, wrinkled, warped or might even tear while traveling over the unsupported area. Of course, such defects and imperfections are undesirable and oftentimes entirely unacceptable, resulting in the production of undue amounts of waste material. In order to avoid creating such defects and imperfections, delicate materials such as extremely thin films and foils are often applied to a rewind core with a lay-on roll. A lay-on roll is quite simply a roll that is located in close proximity to the rewind core. The lay-on roll and rewind core are close enough together to form either a nip point, or at most a short gap between the lay-on roll and rewind core. The lay-on roll therefore essentially applies the web directly onto the rewind core. As mentioned, conventional turret rewinders produce too large of a space for the web to cross over during the splicing step to be used in such applications.

Other examples of no-fold-back splicers include the device disclosed in U.S. Pat. No. 4,422,528 to Richard S. Tetro (The Black Clawson Company) and another device produced by IMD Corporation, which uses a vacuum to transfer the web to the new core during the splicing operation. However, both devices are extremely complex and are severely limited to handling a narrow range of materials and web speeds.

SUMMARY OF THE INVENTION

A duplex web roll winding and splicing device for continuously winding a moving web and for cutting and transferring the web onto a new core with a no-fold-back and wrinkle-free splice is disclosed.

The primary components of the invention include a nip roll, a lay-on roll, an electrostatic generating device, a cutting knife, a first core for winding a first roll of web material, and a second core for winding a second roll of web material. The nip roll is positioned immediately adjacent to the lay-on roll to form a nip point for the web to pass through. The electrostatic generating device is positioned in close proximity to the lay-on roll at a point which is downstream from the nip roll but upstream from the cutting knife. The cutting knife is positioned in close proximity to the lay-on roll at a point which is downstream from the electrostatic generator but upstream from both the first and second cores. Finally, the first and second cores are both positioned downstream from the cutting knife, and each core is independently moveable toward and away from the lay-on roll. Thus, either one or both of the cores may be positioned in close proximity to the lay-on roll at any particular time.

The electrostatic generator is a device which emits an ion charge onto the web in order to temporarily bond or adhere the material to the surface of the lay-on roll. When the cutting knife cuts the web, the tail of the web continues on its normal path to become wound around the old finish roll. Because the new leading edge of the web is electrostatically bonded to the lay-on roll, it does not slip off, but remains there until it reaches the new core. At that point, adhesive on the new core peels the new leading edge off of the cushioned second roll and affixes it onto the new core. Thereafter the web is wound about the new core. As a result, the web is spliced and transferred to the new core without any fold-back or wrinkles.

Additionally, because the two cores are independently moveable relative to the lay-on roll and relative to each other, both cores may be simultaneously positioned in close proximity to the lay-on roll. Consequently, no unduly wide gaps or spaces are created for the web to pass over. Instead the web is applied by the lay-on roll directly onto one core or the other even during the splicing operation. In other words, the lay-on roll is effectively always in contact with one of the rewind cores. When one roll is finished and the splice to the new core has been completed, the finish roll may at that point be independently moved away from the processing line to be removed and replaced with a new core, and then independently returned back into the rewind position and made ready for the next splice. The novel design of the duplex web winding and splicing apparatus is useful for winding a wide range of web materials, especially exceptionally light weight plastic films.

The novel invention disclosed herein provides a number of additional advantages as well. The design is easily adaptable to accommodate a range of core diameters and core widths. The symmetry of the device makes it adaptable for either "over" or "under" winding. The lay-on roll can be more effectively driven so that build-up of the roll is controlled better. Because no turreting is required the size of the machine is comparatively compact, and in particular requires a substantially lower overall height compared to turret rewinders, thereby reducing space requirements in the plant.

The primary objects of the invention are therefore to provide an apparatus and method for changing rolls on a continuous rewind operation which produces a no-fold-back and wrinkle-free splice especially adapted for delicate web materials that normally require a lay-on roll for winding the web about a core; to cut the web at a point before it reaches the new core and to control the web as it is introduced onto the new core; to provide a means for electrostatically charging the web in order to control its movement during the splice; to provide a means for applying an adhesive bond between the new leading edge of the web and the new core; to provide a means for transferring the new leading edge of the web to the new core such that the tail of the web is wound about the finished roll and the new leading edge is smoothly and flatly applied to the new core; to provide a means for independently moving a pair of cores toward and away from the lay-on roll so that the splice can be performed while both the finish roll and new core are in close proximity to the lay-on roll; and to provide a no-fold-back, wrinkle-free splicing mechanism which is adaptable for use in splicing a wide range of web materials on either high-speed or low-speed rewind operations.

Other objects and advantages of the invention will become apparent from the following description which sets forth, by way of illustration and example, certain preferred embodiments of the invention.

BRIEF DESCRIPTION OF THE DRAWINGS

The drawings, which constitute a part of the specification and illustrate an exemplary embodiment of the present invention, include the following.

DETAILED DESCRIPTION OF THE PREFERRED EMBODIMENTS

Figure 1:
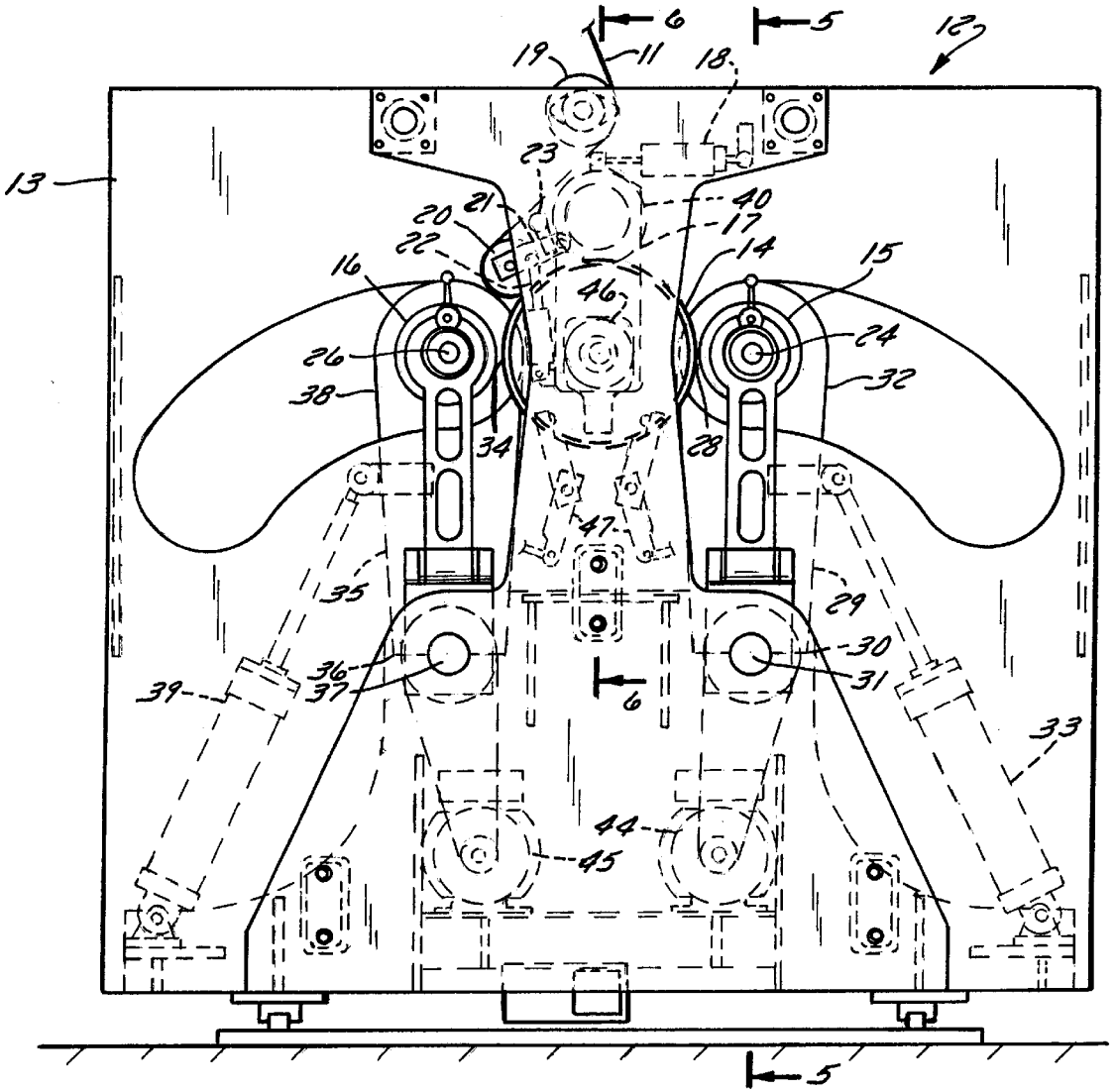
FIG. 1 is a side plan view of the duplex web roll winding and splicing apparatus disclosed herein.
Figure 2:
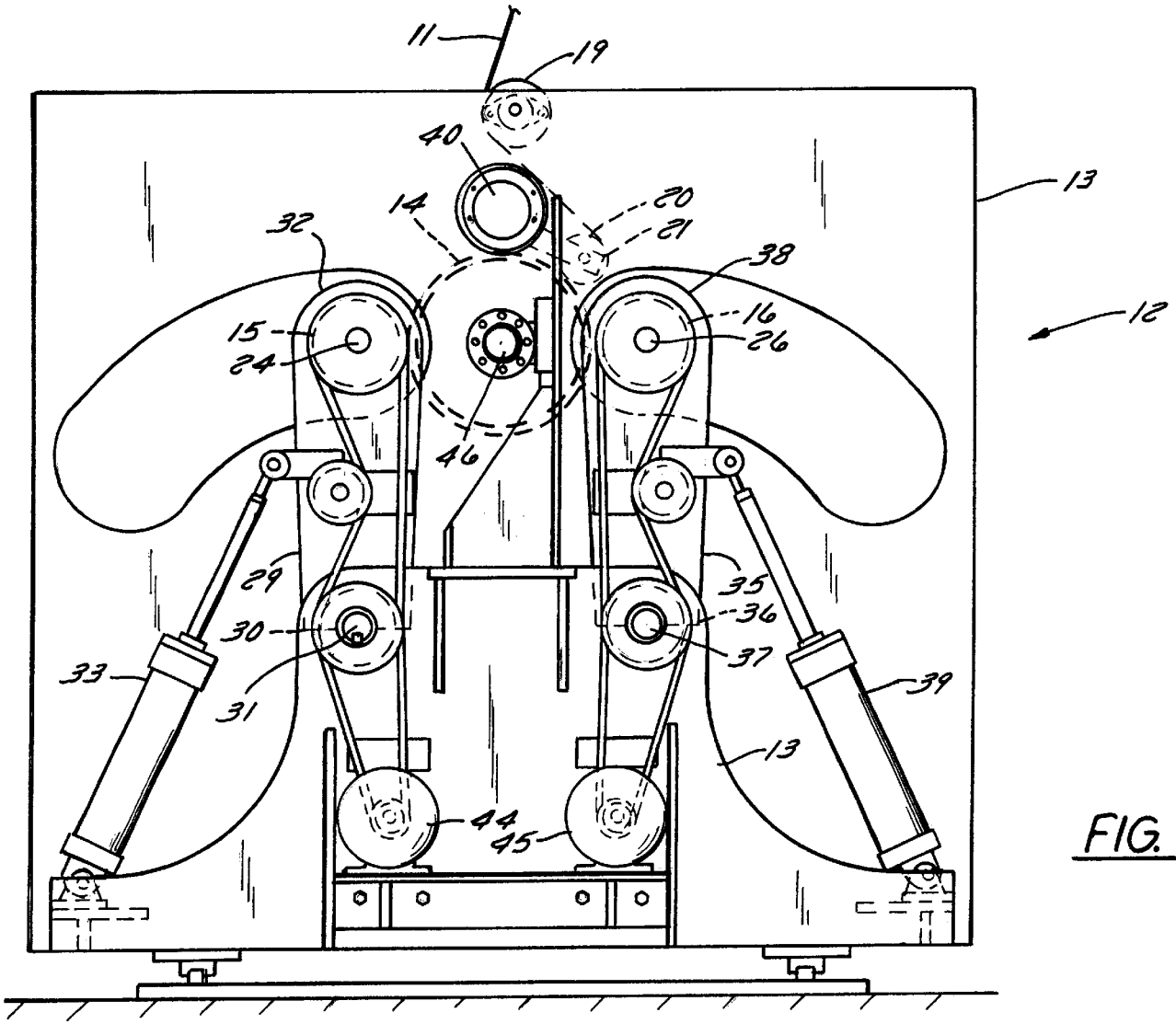
FIG. 2 is an opposite side view of the apparatus.

The duplex web roll winding and splicing apparatus disclosed herein is used primarily for the winding of paper, plastic films, foils, laminations and other web materials which have been processed on coating, printing, laminating, converting or other types of web processing equipment. A web 11 is an extremely thin sheet-like material having a substantially uniform width and potentially unlimited length. The web is wound lengthwise into large rolls, sometimes referred to herein as finish rolls. Such rolls are also referred to in the industry as parent rolls or mill rolls. The apparatus and method disclosed herein are especially adapted for use in continuously winding a moving web and also for splicing the web onto a successive series of rolls in such a manner so as to avoid any fold-backs or wrinkling of the webs during the splicing operation.

Referring in particular to the first embodiment illustrated in FIGS. 1–8, the apparatus 12 includes a frame 13 supporting a centrally located lay-on roll 14. The lay-on roll 14 is used to apply the web 11 onto a first core 15 and second core 16, alternately. The lay-on roll 14 is preferably a substantially hollow roll having a relatively light mass. Additionally, the lay-on roll 14 is preferably mounted on a swing arm 17, which is in turn mounted on the frame 13, thereby enabling the lay-on roll 14 to move laterally a short distance between the first and second cores. The lateral movement of the lay-on roll 14 may be optionally controlled by a hydraulic or pneumatic cylinder 18 operatively connected to the swing arm 17 and to the frame 13.

Figure 3:
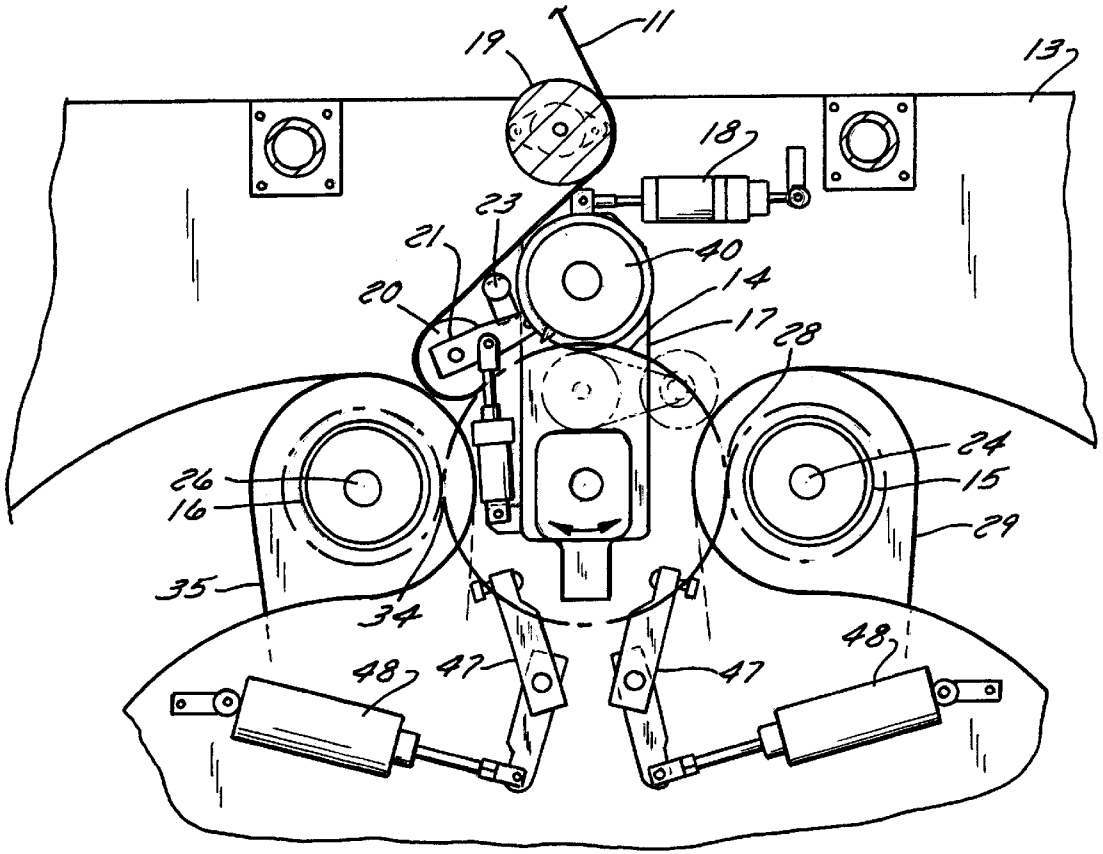
FIG. 3 is a detailed view of the splicing mechanism.

The web 11 is introduced onto the lay-on roll 14 by passing the web 11 across a first idle roll 19 and a second idle roll 20. The second idle roll 20 may be alternatively referred to as a nip roll in that it is positioned in close proximity to the lay-on roll 14 so as to form a nip point between the nip roll 20 and lay-on roll 14. Referring to FIGS. 1 and 3 in particular, the nip roll 20 is also preferably mounted on a second swing arm 21 for moving the nip roll 20 toward the lay-on roll 14 to form the nip point in preparation for splicing (discussed further below), and for optionally moving the nip roll 20 away from the lay-on roll 14 to form a short gap between the nip roll and lay-on roll during normal rewinding operations. A pneumatic or hydraulic cylinder 22 operatively connected to the nip roll swing arm 21 and to the frame 13 may be used to pivot the nip roll 20 toward and away from the lay-on roll 14. The web 11 is introduced onto the lay-on roll 14 by passing it through the nip point between the nip roll 20 and the lay-on roll 14.

Immediately downstream from the nip point, an electrostatic charging bar 23, connected to an electrostatic generator, is positioned across the width of the web 11 in close proximity to the lay-on roll 14 so that the web passes between the electrostatic bar and the lay-on roll. The electrostatic charging bar 23 emits an intense field of ions toward a ground point, which in this case is the lay-on roll 14. The ion charge temporarily adheres the web 11 electrostatically to the surface of the lay-on roll 14. Suitable electrostatic generators and charging bars are available from, for example, Simco, Hatfield, Pa., and from Hurletron Incorporated, Lincolnshire, Ill., as well as several other manufacturers.

The apparatus further includes a first spindle 24 for supporting the first core 15 for winding the web 11 into a first roll 25, and a second spindle 26 for supporting the second core 16 for winding the web 11 into a second roll 27. The first spindle 24 includes a means for selectively and independently moving the first core 15 toward and away from a first portion 28 of the lay-on roll 14. Referring to the preferred embodiment of the invention illustrated in FIGS. 1–8, the means for moving the first core 15 comprises a first pivot arm 29. The first pivot arm 29 includes a first end 30 attached to the frame 13 for rotation about a first pivot axis 31, and a second end 32 upon which the first spindle 24 is mounted. A first pneumatic or hydraulic cylinder 33 is operatively attached to the first pivot arm 20 and to the frame 13 for moving the first pivot arm 20, and thereby moving the first core 15 toward and away from the first portion 28 of the lay-on roll 14.

The second spindle 26 includes means for selectively and independently moving the second core 16 toward and away from a second portion 34 of the lay-on roll 14. Referring again to FIGS. 1–8, the means for moving the second core 16 comprises a second pivot arm 35. The second pivot arm 35 includes a third end 36 attached to the frame 13 for rotation about a second pivot axis 37, and a fourth end 38 upon which the second spindle 26 is mounted. A second pneumatic or hydraulic cylinder 39 is operatively attached to the second pivot arm 35 and to the frame 13 for pivotally moving the second core 16 towards and away from the second portion 34 of the lay-on roll 14.

With reference to FIG. 1, the first portion 28 of the lay-on roll is on one side of the lay-on roll 14, and the second portion 34 is on the opposite side of the lay-on roll 14. Consequently, the first pivot arm 29 and second pivot arm 35 are symmetrically mounted to the opposite sides of the frame 13. Additionally, the first and second pivot arms are capable of moving the first and second cores, respectively, toward and away from the lay-on roll independently of each other. Both the first portion 28 and second portion 34 of the lay-on roll 14 are downstream from the nip roll 20, and the electrostatic charging bar 23.

The apparatus 12 further includes a cutting knife 40 which extends across the width of the web 11 at a location which is downstream from the electrostatic charging bar 23 but upstream from both the first core 15 and second core 16. The knife 40 is preferably mounted on a rotatable knife holder positioned across the width of the web 11. The web 11 of course passes between the cutting knife 40 and the lay-on roll 14. The lay-on roll 14 acts like an anvil or cutting block in cooperation with the knife 40 in order to cut the web 11. The outer surface of the lay-on roll 14 is preferably covered with a cushion of rubber or similar material. The knife 40 is actuated so that the extreme edge of the knife rotates at approximately the same arch speed as the outer surface of the lay-on roll 14, which is also the same linear speed that the web 11 is moving. Upon initiation of the cutting action of the knife 40, the knife 40 may be allowed to at that point rotate freely so that the knife 40 initially digs into the web 11 and into the outer cushion of the lay-on roll 14 and then is carried through the cutting arch at the same speed that the web 11 and lay-on roll 14 are moving. This cutting action provides for a straight, clean cut of the web material thereby producing a tail 41 and a new leading edge 42.

Figure 4:
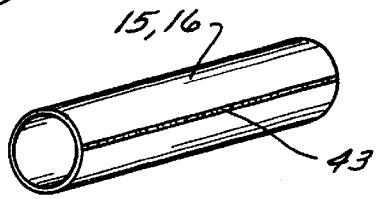
FIG. 4 is a perspective view of a core.
Figure 5:
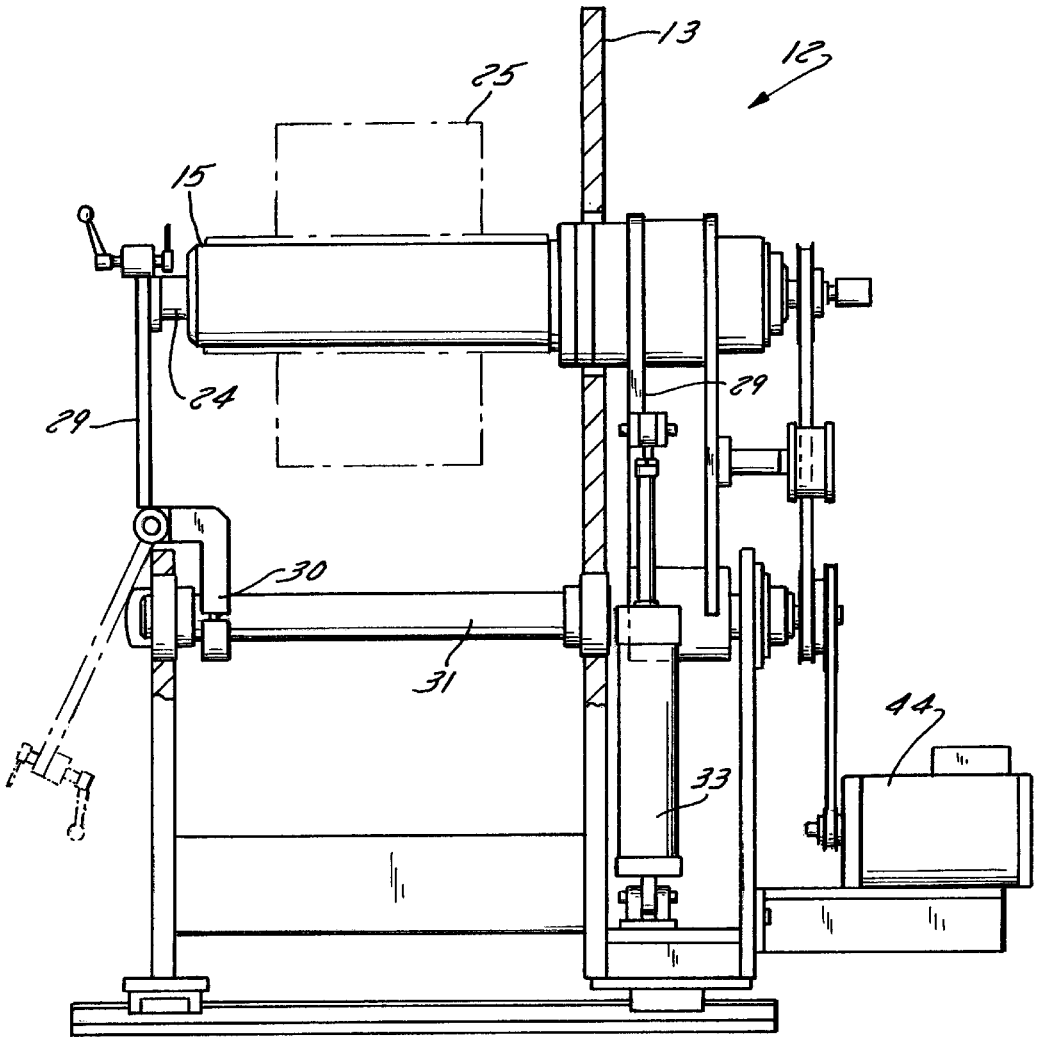
FIG. 5 is a sectional side view of the apparatus essentially along line 5—5 of FIG. 1.
Figure 6:
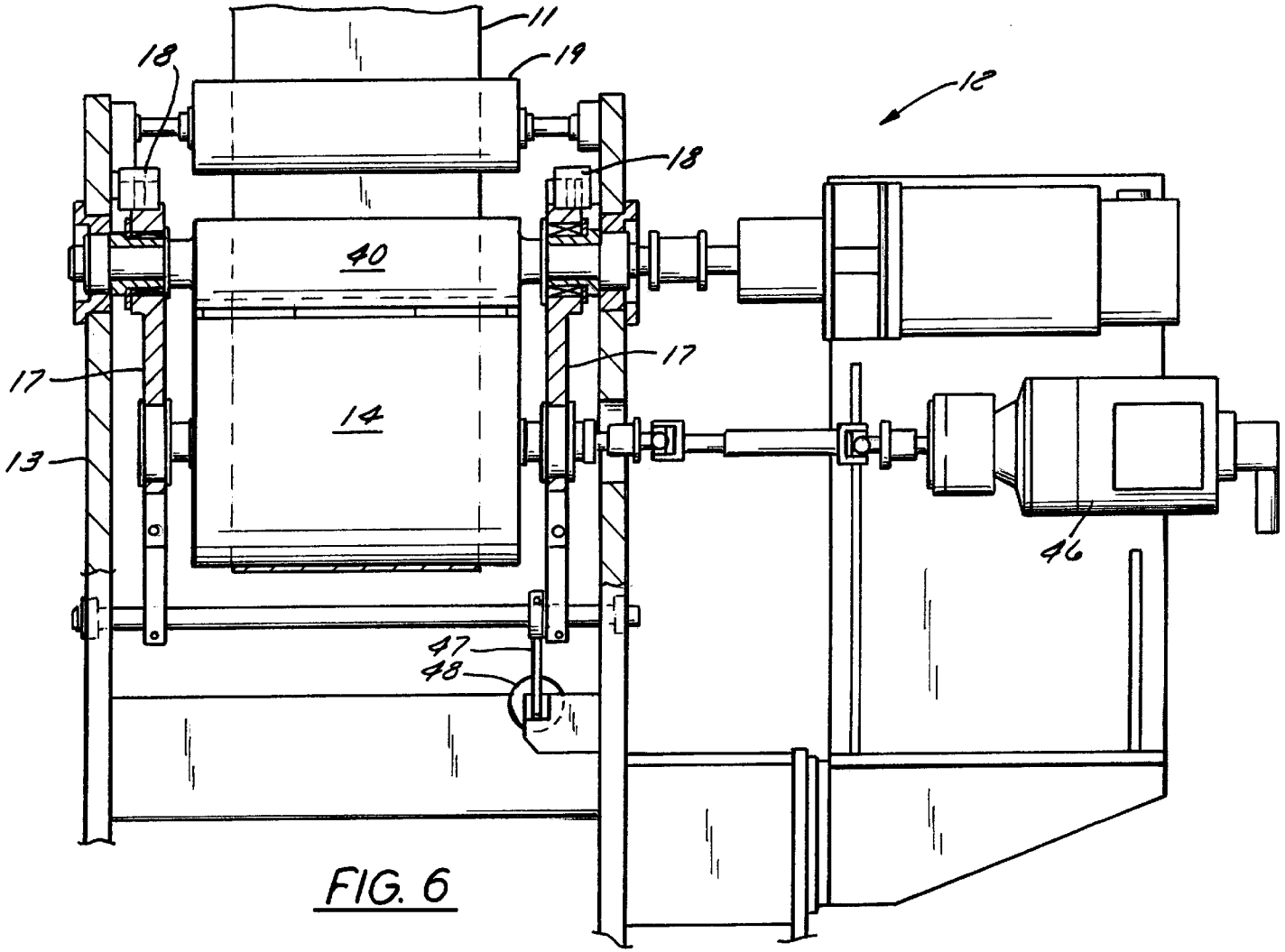
FIG. 6 is a sectional side view of the apparatus essentially along line 6—6 of FIG. 1.

Referring to FIG. 4, the cores 15 and 16 consist of long cardboard or metal tubes of the type commonly used to rewind web material. The core has an adhesive coating applied to its outer surface for bonding to the web to the core. Preferably, the core is provided with a narrow strip of double-sided adhesive tape 43 applied down the length of the core, and the splicing of the web 11 is synchronized with the rotation of the core so that the new leading edge 42 of the web is applied directly to the narrow strip of adhesive tape 43.

The apparatus also preferably includes a first motor 44 operatively connected to the first spindle 24 for driving rotation of the first core 15 in order to wind the web material to a first roll 25, and a second motor 45 operatively connected to the second spindle 26 for driving rotation of the second core 16 in order to wind the web material into a second roll 27. Preferably, the apparatus further includes a third motor 46 for driving rotation of the lay-on roll 14 in order to have better control of the build-up of the web.

As mentioned, the lay-on roll 14 is preferably mounted on a swing arm 17 to provide a small amount of lateral movement back and forth between the first core 15 and second core 16. The apparatus 12 preferably also includes a means for momentarily bumping the lay-on roll 14 against the core upon which the new leading edge 42 of the web is to be applied. Referring to FIGS. 1 and 3, the lay-on roll 14 may be bumped into the new core through the use of a hammer arm 47 operatively connected to a quick acting pneumatic cylinder 48. Upon actuation of the cylinder 48, the hammer arm 47 strikes the swing arm 17 thereby causing the lay-on roll 14 to move a short distance towards the new core. Consequently, the new core may be placed a short distance away from the lay-on roll 14 in order to allow the tail 41 of the web to continue traveling to the roll upon which the web is being wound, and upon splicing the lay-on roll 14 is quickly moved into engagement with the new core so that the new leading edge 42 is applied onto the strip of adhesive tape 43 on the new core.

Figure 7:
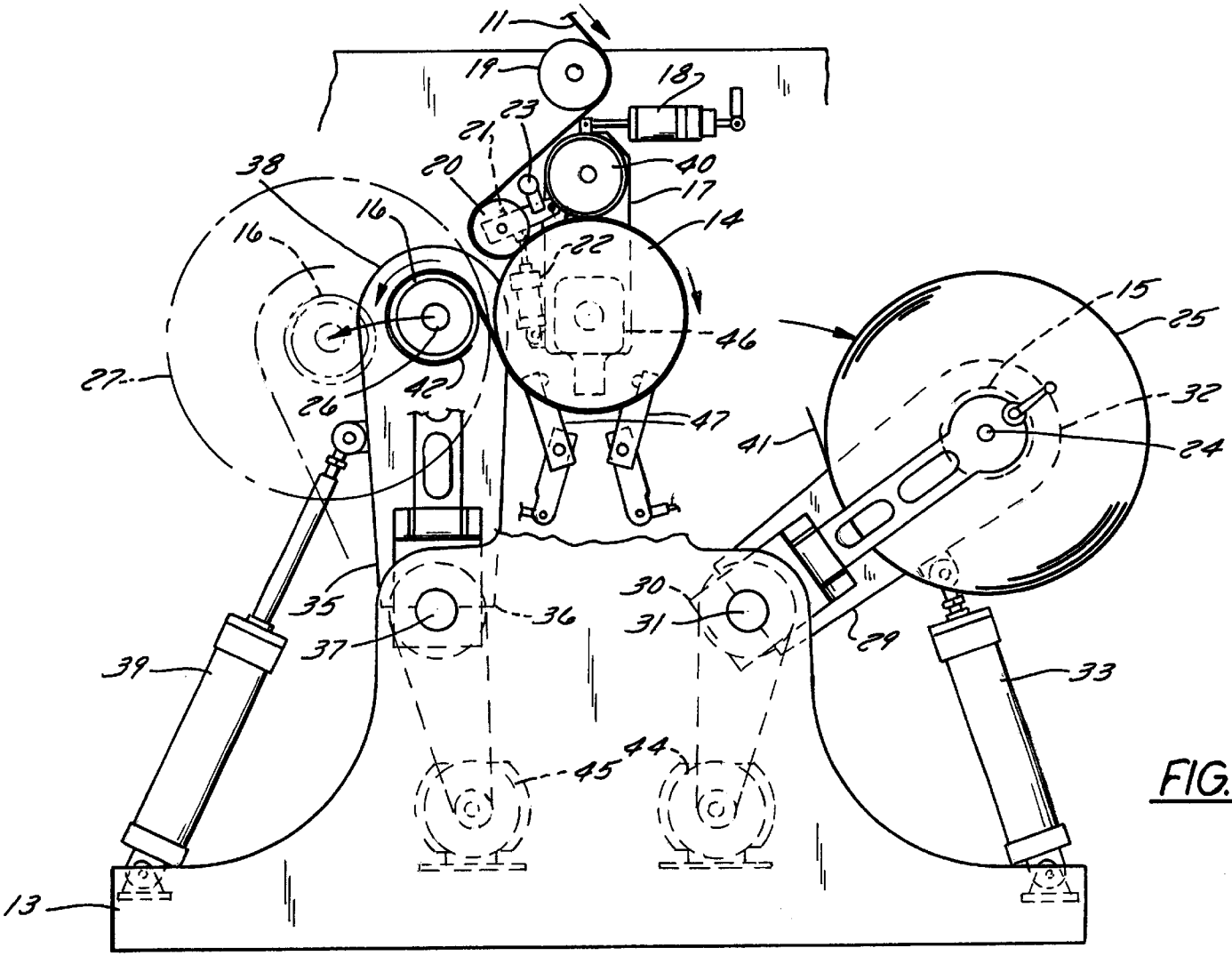
FIG. 7 is a detailed view illustrating the method of splicing of the web from one roll to the other.
Figure 8:
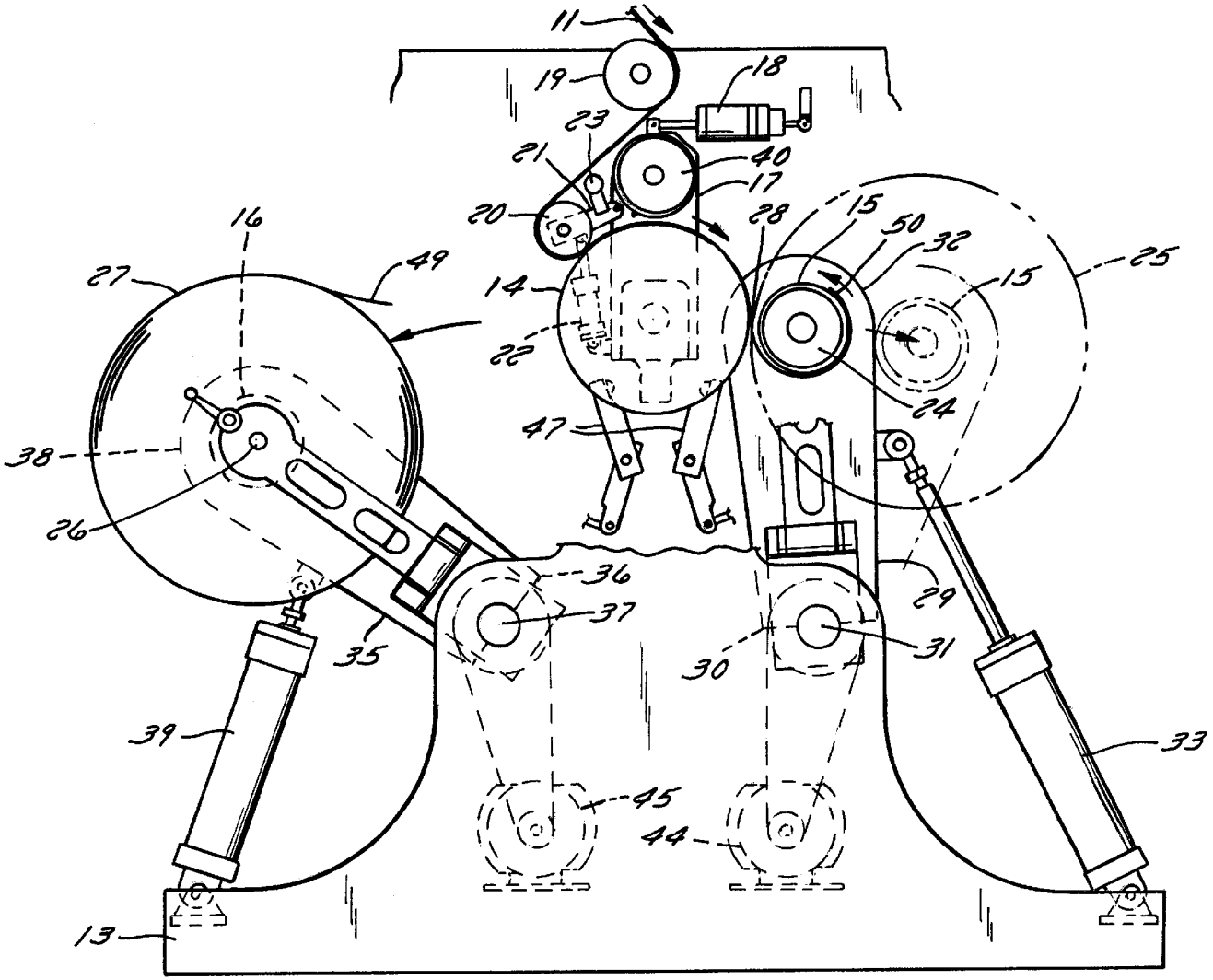
FIG. 8 is a further detailed view illustrating the method of splicing of the web from one roll to the other.

Having thus described the preferred embodiment of the apparatus 12, the method for winding and splicing the web is as follows. Referring in particular to FIGS. 3, 7 and 8, the web 11 is introduced onto the surface of the lay-on roll 14 by feeding it through the nip point between the nip roll 20 and the lay-on roll 14. A first core 15 is placed onto the first spindle 24, and the first core 15 is then moved into close proximity to the first portion 28 of the lay-on roll 14. The web 11 is applied to the first roll 15 and wound about the first core into a first roll 25. A second core 16 is placed onto the second spindle 26, and the second core 16 is then moved, independently of the first core 15, into close proximity to the second portion 34 of the lay-on roll 14.

Upon passing through the nip point and being applied to the lay-on roll 14, the web 11 is then electrostatically charged at a location downstream from the nip point but upstream from the cores in order to temporarily adhere the web 11 onto the lay-on roll 14. The moving web 11 is then cut across its width at a location downstream from where the web is electrostatically charged but upstream from the cores. The web is severed completely in order to produce a tail 41 and a new leading edge 42. The tail 41 continues to be wound about the first core 14. As the new leading edge 42 approaches the second core 16, the second core 16 is placed in contact with the web so that the new leading edge 42 becomes affixed to the adhesive strip 43 on the second core 16. The adhesive strip 43 on the second core 16 essentially peels the new leading edge 42 away from the lay-on roll 14 and thereafter winds the web around the second core 16 into a second roll 27. Upon completion of the splice, the first core 15 is then independently moved away from the lay-on roll 14 so that the finished first roll 25 may be removed.

The winding operation is continued and made ready for a further splice by replacing a new first core 15 onto the first spindle 24, and then independently moving the new first core 15 back into close proximity to the lay-on roll 14. The web is cut again to produce a second tail 49 and a second new leading edge 50. The second tail 49 is wound about the second core 16, and the second new leading edge 50 is then affixed onto the new first core 15 for winding the web into another roll. At that point, the second core 16 may then be independently moved away from the lay-on roll 14 for removal of the finished second roll 27, with another new core replaced onto the second spindle 26. The above-described process may be repeated in order to continuously wind the web into a successive series of finished rolls.

As mentioned, the sequence of events are preferably synchronized so that the new leading edge is applied directly onto the narrow strip of adhesive tape on the new core. This can be accomplished by placing a position sensor on the spindle for locating the relative position of the adhesive tape on the new core, by calculating the speed and distance that the web travels from the point that the web is cut to the point that it reaches the new core, and by controlling the timing of the cut made by the knife so that the new leading edge reaches the new core at the same moment that the adhesive tape comes in contact with the web.

Figure 9:
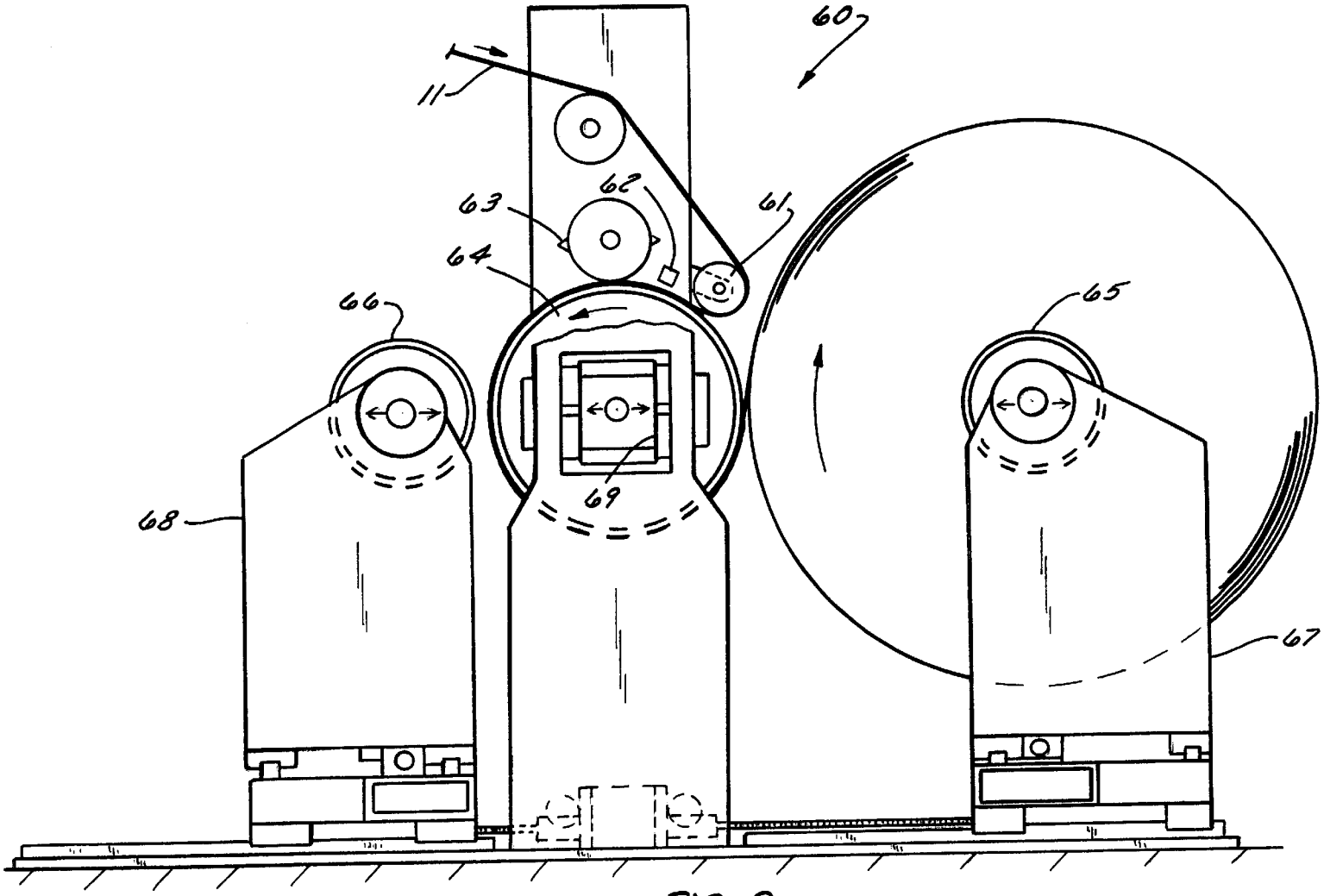
FIG. 9 is a side plan view of a second embodiment of the invention.

Finally, it is recognized that the present invention may be constructed in a number of configurations all of which satisfy the primary objective of continuously winding a moving web and for also providing a no-fold-back, wrinkle free splice of the web. For example, FIG. 9 depicts a second preferred embodiment of an apparatus 60 which likewise includes as essential elements a nip roll 61, electrostatic charging bar 62, cutting knife 63, lay-on roll 64, and first core 65 and second core 66. On the device depicted in FIG. 9, the means for independently moving the first core 65 comprises a first carriage 67. The first carriage 67 is slidable relative to the lay-on roll 64 for sliding the first core 65 toward and away from a first portion of the lay-on roll 64. The means for independently moving the second core 66 comprises a second carriage 68, the second carriage 68 being similarly slidable relative to the lay-on roll 64 for sliding the second core 66 toward and away from the second portion of the lay-on roll 64. Additionally, the lay-on roll 64 may be mounted on a slidable central carriage 69 to provide a slight amount of lateral movement between the cores.

Figure 10:
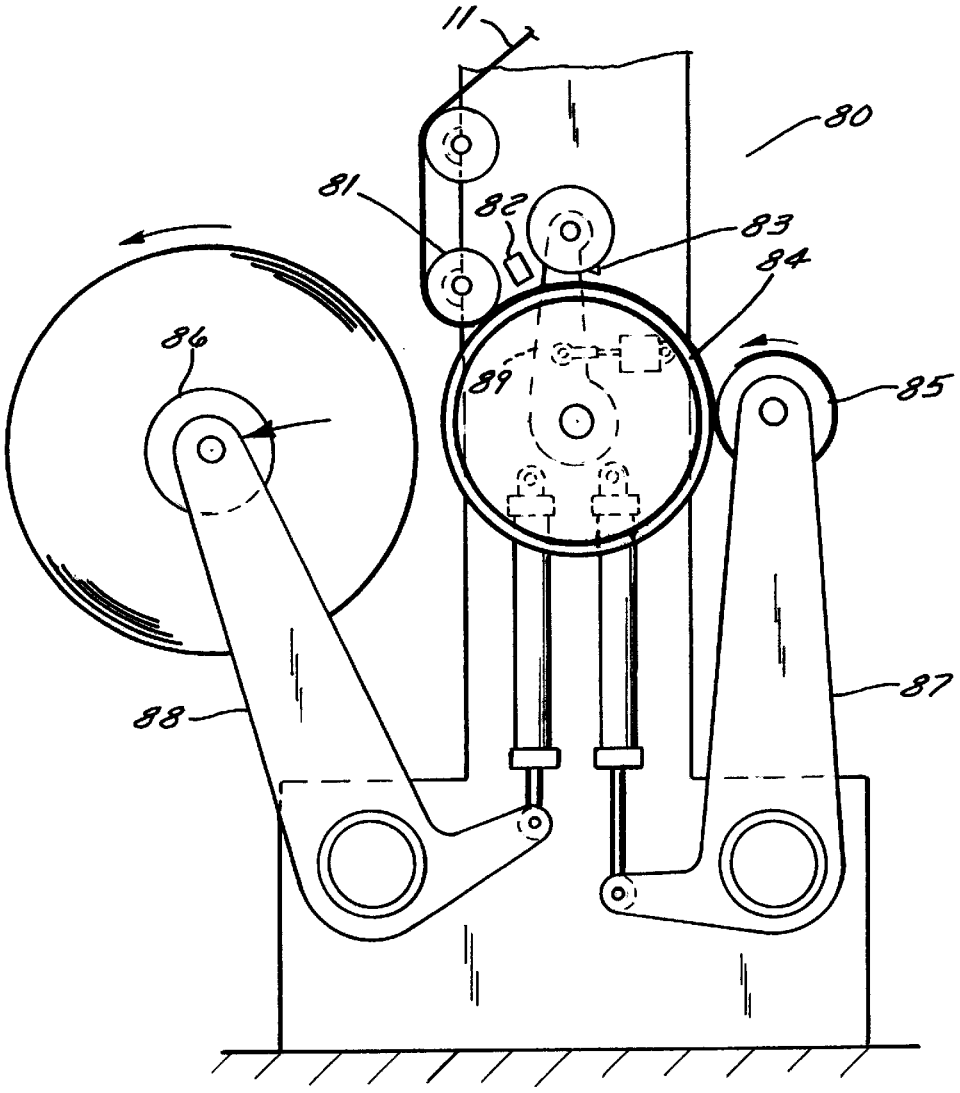
FIG. 10 is a side view of a third embodiment of the invention.

FIG. 10 depicts a further alternative embodiment of an apparatus 80 which likewise includes as essential elements a nip roll 81, electrostatic charging bar 82, cutting knife 83, lay-on roll 84, first core 85, and second core 86. Like the embodiment depicted in FIGS. 1–8, the embodiment depicted also includes pivot arms 87 and 88 for the first and second cores and a swing arm 89 for the lay-on roll. Furthermore, alternative mechanisms for actuating and repositioning the cutting knife may be employed, and in that regard the applicant's prior U.S. Pat. Nos. 5,368,253 and 5,823,461 are incorporated herein by reference.

Therefore, specific details of the apparatus and method disclosed above are not to be interpreted as limiting the scope of the invention, but are presented herein merely to provide a basis for the claims and for teaching those skilled in the art to make and use the present invention in any appropriately detailed manner. As mentioned, changes may be made in certain details of the preferred embodiments described above without departing from the spirit of the invention, especially as defined in the following claims.

What is claimed is:

1. An apparatus for rewinding a continuously moving web and for splicing and transferring the web from a first core to a second core, said apparatus comprising:

a first spindle for supporting said first core for winding the web into a roll;

a second spindle for supporting said second core for winding the web into a second roll;

a lay-on roll for applying the web onto the first and second cores;

a nip roll, said nip roll being positioned immediately adjacent to said lay-on roll in order to form a nip point for the web to pass through;

an electrostatic charging bar located in close proximity to the lay-on roll at a point downstream from the nip point for temporarily adhering the web to the lay-on roll;

a cutting knife positioned downstream from the electrostatic charging bar, the cutting knife being cooperatively engageable with the lay-on roll for splicing the web to thereby form a tail and a new leading edge;

said first spindle including means for independently moving the first core toward and away from a first portion of the lay-on roll;

said second spindle including means for independently moving the second core toward and away from a second portion of the lay-on roll; and, said first and second portions of the lay-on roll both being downstream of the cutting knife;

whereby, upon splicing the web, the tail is wound about the first core and the new leading edge is peeled away from the lay-on roll and affixed onto the second core and the web is thereafter rewound about the second core.

2. The apparatus of claim 1, wherein:

the means for independently moving the first core comprises a first pivot arm for pivoting the first core toward and away from the first portion of the lay-on roll; and the means for independently moving the second core comprises a second pivot arm for pivoting the second core toward and away from the second portion of the lay-on on roll.

3. The apparatus of claim 2, wherein:

the first pivot arm includes a first end attached for rotation about a first pivot axis, a second end upon which the first spindle is mounted, and a first extendable cylinder operatively attached to the first pivot arm and to the frame for moving the first core toward and away from the first portion of the lay-on roll; and the second pivot arm includes a third end attached for rotation about a second pivot axis, a fourth end upon which the second spindle is mounted, and a second extendable cylinder operatively attached to the second pivot arm and to the frame for moving the second core toward and away from the second portion of the lay-on roll.

4. The apparatus of claim 1, wherein:

the means for independently moving the first core comprises a first carriage, said first carriage being slidable relative to said lay-on roll for sliding said first core toward and away from said first portion of the lay-on wall; and the means for independently moving the second core comprises a second carriage, said second carriage being slidable relative to said lay-on roll for sliding said second core toward and away from said second portion of the lay-on roll.

5. The apparatus of claim 1, wherein the nip roll is optionally movable toward the lay-on roll for forming the nip point therebetween, and away from the lay-on roll to form a short space therebetween.

6. The apparatus of claim 1, further comprising:

a first motor operatively connected to the first spindle for driving rotation of the first core; and, a second motor operatively connected to the second spindle for driving rotation of the second core.

7. The apparatus of claim 6, further comprising a third motor for driving rotation of the lay-on roll.

8. The apparatus of claim 7, wherein each core includes a narrow strip of double-sided adhesive tape extending longitudinally down the length of the core, and the apparatus further comprises means for synchronizing rotation of the cores with the cutting action of the knife so that the new leading edge of the web is affixed directly onto the strip of adhesive tape on the core.

9. The apparatus of claim 8 further comprising a means for momentarily bumping the lay-on roll against the core upon which the new leading edge is being affixed.

10. The apparatus of claim 9, wherein the means for bumping comprises a cylinder actuated hammer for striking the swing arm to slightly move the lay-on roll toward the core upon which the new leading edge is being affixed.

11. The apparatus of claim 8, further comprising a swing arm, and the lay-on roll is mounted on the swing arm for lateral movement between the first core and second core.

12. An apparatus for continuously winding and splicing a moving web onto first and second cores, said apparatus comprising:

a center roll;

means for introducing the web onto the center roll;

an electrostatic emitter located in close proximity to the center roll for temporarily adhering the web to the center roll;

a cutting knife located downstream from the electrostatic emitter, said cutting knife being cooperatively engageable with the center roll for severing the web to thereby form a tail and a new leading edge of the web;

a first spindle for supporting the first core downstream from said cutting knife for winding the web thereon;

means for moving said first spindle toward and away from said center roll;

a second spindle for supporting the second core downstream from said cutting-knife for winding the web thereon;

second means for moving said second spindle toward and away from said center roll independently of said first spindle;

whereby, upon splicing, the tail of the web is wound around one core and the new leading edge becomes affixed onto the other core and the web is thereafter rewound about the other core.

13. The apparatus of claim 12, wherein:

the means for moving the first spindle comprises a first pivot arm and a first extendable cylinder for operating said pivot arm, said first spindle being mounted on an end of said first pivot arm for movement toward and away from a first portion of said center roll; and the second means for moving the second spindle comprises a second pivot arm and a second extendable cylinder for operating the second pivot arm, said second spindle being mounted on an end of said second pivot arm for movement toward and away from a second portion of said center roll.

14. The apparatus of claim 12, wherein:

the means for moving the first spindle comprises a first carriage mounted for slidable movement along a first rail for sliding said first spindle toward and away from a first portion of the center roll; and the means for moving the second spindle comprises a second carriage mounted for slidable movement along a second rail for sliding said second spindle toward and away from a second portion of the center roll.

15. The apparatus of claim 12, wherein each core includes a narrow strip of double-sided adhesive tape extending longitudinally down the length of the core, and the apparatus further comprises means for synchronizing rotation of the cores with the cutting action of the knife so that the new leading edge of the web is affixed directly onto the strip of adhesive tape on the core.

16. The apparatus of claim 12, further comprising a swing arm, said center roll being mounted on said swing arm for lateral movement independently of the movement of the first and second spindles.

17. The apparatus of claim 16, further comprising means for momentarily bumping the center roll against one of the cores during splicing.

18. The apparatus of claim 12, wherein the means for introducing the web onto the center roll comprises a nip roll positioned immediately adjacent to the center roll thereby forming a nip point for the web to pass through, said nip point being upstream from the cutting knife.

19. The apparatus of claim 18, further comprising a second swing arm, said nip roll being mounted on said second swing arm for movement toward the center roll to thereby form said nip point and thereby introduce the moving web directly onto the center roll in preparation for splicing, and away from the center roll during normal winding of the web.

20. A method of continuously winding and splicing a moving web onto first and second cores, said method comprising:

a. introducing the web onto a roller:

b. moving a first core into close proximity of a first portion of the roller and winding the web about the first core into a roll;

c. independently moving a second core into close proximity of a second portion of the roller;

d. electrostatically charging the web at a location upstream of the cores in order to temporarily adhere the web to the roller;

e. cutting the moving web across its width at a location downstream from where the web is electrostatically charged but upstream from the first and second cores thereby producing a tail and a new leading edge;

f. winding the tail about the first core; and g. removing the new leading edge from the roller and affixing it onto the second core and thereafter winding the web around the second core into a second roll.

21. The method of claim 20, further comprising:

h. independently moving the first core away from the roller to remove the finished roll;

i. replacing the first core;

j. independently moving the first core back into close proximity of the roller;

k. cutting the web again to produce a second tail and a second new leading edge;

l. winding the second tail about the second core; and m. removing the second new leading edge from the roller and affixing it onto the first core and thereafter winding the web around the first core into another roll.

22. The method of claim 21, further comprising:

n. independently moving the second core away from the roller to remove the finished second roll;

o. replacing the second core;

p. repeating steps c through o to continuously wind the web into a successive series of finished rolls.

23. The method of claim 20, wherein the steps of moving the first and second cores are comprised of pivoting the cores about independently operative first and second pivot arms, respectively.

24. The method of claim 20, wherein the steps of moving the first and second cores are comprised of sliding the cores toward and away from the roller on independently operative first and second carriages, respectively.

25. The method of claim 22, further comprising:

applying a narrow strip of double-sided adhesive tape onto the surface of the cores; and synchronizing rotation of the cores with the cutting of the web so that for each splice the new leading edge meets and is thereby affixed onto the strip of tape.

* * * * *